US009907121B2

(12) United States Patent
Miller et al.

(10) Patent No.: US 9,907,121 B2
(45) Date of Patent: Feb. 27, 2018

(54) PARALLEL WIRE CONDUCTOR FOR USE WITH A HEATING BLANKET

(71) Applicant: The Boeing Company, Chicago, IL (US)

(72) Inventors: Robert James Miller, Seattle, WA (US); Christopher John Hottes, Seattle, WA (US); Marc Rollo Matsen, Seattle, WA (US); James M. Kestner, Seattle, WA (US); Cameron Kai-Ming Chen, Seattle, WA (US); Leah Gillian Glauber, Seattle, WA (US)

(73) Assignee: The Boeing Company, Chicago, IL (US)

( * ) Notice: Subject to any disclaimer, the term of this patent is extended or adjusted under 35 U.S.C. 154(b) by 233 days.

(21) Appl. No.: 14/640,217

(22) Filed: Mar. 6, 2015

(65) Prior Publication Data

US 2016/0262215 A1 Sep. 8, 2016

(51) Int. Cl.

| | |
|---|---|
| ***H05B 3/34*** | (2006.01) |
| ***H05B 6/10*** | (2006.01) |
| ***H05B 6/40*** | (2006.01) |

(52) U.S. Cl.

CPC ..... *H05B 6/105* (2013.01); *H05B 6/40* (2013.01); *H05B 2203/003* (2013.01); *H05B 2206/023* (2013.01)

(58) Field of Classification Search

CPC . H05B 6/105; H05B 6/40; H05B 3/54; H05B 3/146; H05B 3/34; H05B 2203/017; H05B 2203/029; H05B 2203/003; H05B 2206/023

USPC ..... 219/212, 528, 529, 634

See application file for complete search history.

(56) References Cited

U.S. PATENT DOCUMENTS

| | | | |
|---|---|---|---|
| 3,946,349 | A | 3/1976 | Haldeman, III |
| 4,366,356 | A | 12/1982 | Ando |
| 5,313,037 | A | 5/1994 | Hansen et al. |
| 6,528,771 | B1 | 3/2003 | Matsen et al. |

(Continued)

*Primary Examiner* — Brian Jennison

(74) *Attorney, Agent, or Firm* — McDonnell Boehnen Hulbert & Berghoff LLP

(57) ABSTRACT

A wire conductor for receiving alternating current and generating a magnetic field in response thereto. The wire conductor comprises a plurality of wire conductors in a parallel configured circuit extending between a first side of the wire conductor towards a second side of the wire conductor. A first layer of the plurality of wire conductors running in parallel from a first edge of the wire conductor to a second edge of the wire conductor. A second layer of parallel wire conductors residing above the first layer of the plurality of wire conductors, the second layer of parallel wire conductors running in parallel from the first edge of the wire conductor to the second edge of the wire conductor. The first layer of parallel wire conductors make a 180 degree turn along the first edge of the wire conductor. The first layer of parallel wire conductors make the 180 degree turn along the first edge of the wire conductor by first turning 90 degrees towards the second side of the parallel wire conductor. The first layer of parallel wire conductors make the 180 degree turn along the first edge of the wire conductor by first turning 90 degrees towards the second side of the parallel wire conductor, and then by turning 90 degrees towards the second edge of the parallel wire conductor.

21 Claims, 10 Drawing Sheets

(56) References Cited

U.S. PATENT DOCUMENTS

| | | | | |
|---|---|---|---|---|
| 6,884,975 | B2 | 4/2005 | Matsen et al. | |
| 8,330,086 | B2 | 12/2012 | Miller et al. | |
| 2004/0035854 | A1* | 2/2004 | Cheng | H05B 3/56 219/549 |
| 2008/0128078 | A1 | 6/2008 | May et al. | |
| 2010/0065542 | A1* | 3/2010 | Dubey | H05B 3/34 219/213 |
| 2011/0139769 | A1* | 6/2011 | Miller | B29C 73/30 219/634 |
| 2012/0145702 | A1 | 6/2012 | Miller et al. | |
| 2013/0134154 | A1 | 5/2013 | Matsen et al. | |
| 2014/0061183 | A1* | 3/2014 | Li | H05B 3/34 219/528 |

* cited by examiner

PARALLEL WIRE CONDUCTOR FOR USE WITH A HEATING BLANKET

FIELD

The present disclosure relates generally to susceptors for use with heating blankets. More particularly, the present disclosure relates to parallel wire conductors for use with heating blankets wherein the blankets are used to heat a structure to a substantially uniform temperature.

BACKGROUND

The reworking of composite structures frequently requires the localized application of heat. When installing a patch in a rework area of a composite structure, heat must typically be applied to the adhesive at the bondline between the patch and rework area in order to fully cure the adhesive. When applying heat to the patch, the temperature of the bondline must typically be maintained within a temperature range that must be held for an extended period of time until the adhesive is cured. Overheating or under heating the rework area or structure located adjacent to the rework area is generally undesirable during the rework process.

Conventional heating equipment for heating composite structures may include heating blankets comprised of electrically resistive heating elements. Variations in the construction of conventional heating blankets may result in differential heating across the rework area. In addition, conventional heating blankets may lack the ability to compensate for heat sinks located adjacent to the rework area. Such heat sinks may comprise various elements such as stiffeners, stringers, ribs, bulkheads, and other structural members in thermal contact with the structure. Attempts to provide uniform heat distribution using conventional resistive heating blankets include multi-zone blanket systems, feedback loop systems, positive temperature coefficient heating elements, and temperature stabilizing plugs. Additions of such systems to conventional resistive heating blankets are generally ineffective in providing a substantially uniform temperature without substantial variation across the bondline of the rework area.

As can be seen, there exists a need for a system and method for heating a structure such as a rework area of a composite structure in a manner which maintains a substantially uniform temperature across the rework area. More specifically, there exists a need for a system and method for uniformly heating a composite structure and which accommodates heat drawn from the rework area by heat sinks and other thermal variations located adjacent to the rework area. Furthermore, there exists a need for a system and method for uniformly heating a composite structure in a manner which prevents overheating or under heating of the composite structure. Ideally, such system and method for uniformly heating the composite structure is low in cost and simple in construction. There is also a need for a system that provides for temperature regulation over a broad range of temperatures typically required for composite processing, for example, from about 150° F. to about 350° F.

There is also a need for a system that reduces certain unwanted induction effects that may be generated by high frequency electric currents in nearby conductive material, such as metal tooling and graphite composite structures.

SUMMARY

According to an exemplary arrangement, a wire conductor for receiving alternating current and generating a magnetic field in response thereto is disclosed. The wire conductor comprises a plurality of wire conductors in a parallel configured circuit extending between a first side of the wire conductor towards a second side of the wire conductor. A first layer of the plurality of wire conductors running in parallel from a first edge of the wire conductor to a second edge of the wire conductor. A second layer of parallel wire conductors residing above the first layer of the plurality of wire conductors, the second layer of parallel wire conductors running in parallel from the first edge of the wire conductor to the second edge of the wire conductor. The first layer of parallel wire conductors make a 180 degree turn along the first edge of the wire conductor. The first layer of parallel wire conductors make the 180 degree turn along the first edge of the wire conductor by first turning 90 degrees towards the second side of the parallel wire conductor. The first layer of parallel wire conductors make the 180 degree turn along the first edge of the wire conductor by first turning 90 degrees towards the second side of the parallel wire conductor, and then by turning 90 degrees towards the second edge of the parallel wire conductor.

In one arrangement, a heating blanket comprises a wire conductor for receiving alternating current and generating a magnetic field in response thereto. The wire conductor comprising a plurality of wire conductors in a parallel configured circuit extending between a first side of the wire conductor towards a second side of the wire conductor. A first layer of the plurality of wire conductors running in parallel from a first edge of the wire conductor to a second edge of the wire conductor. A second layer of parallel wire conductors residing above the first layer of the plurality of wire conductors. The second layer of parallel wire conductors may run in parallel from the first edge of the wire conductor to the second edge of the wire conductor. The first layer of parallel wire conductors make a 180 degree turn. The first layer of parallel wire conductors may make the 180 degree turn along the first edge of the wire conductor.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and descriptions thereof, will best be understood by reference to the following detailed description of an illustrative embodiment of the present disclosure when read in conjunction with the accompanying drawings, wherein:

DETAILED DESCRIPTION

Disclosed embodiments will now be described more fully hereinafter with reference to the accompanying drawings, in which some, but not all of the disclosed embodiments are shown. Indeed, several different embodiments may be provided and should not be construed as limited to the embodiments set forth herein. Rather, these embodiments are provided so that this disclosure will be thorough and complete and will fully convey the scope of the disclosure to those skilled in the art.

Figure 1:
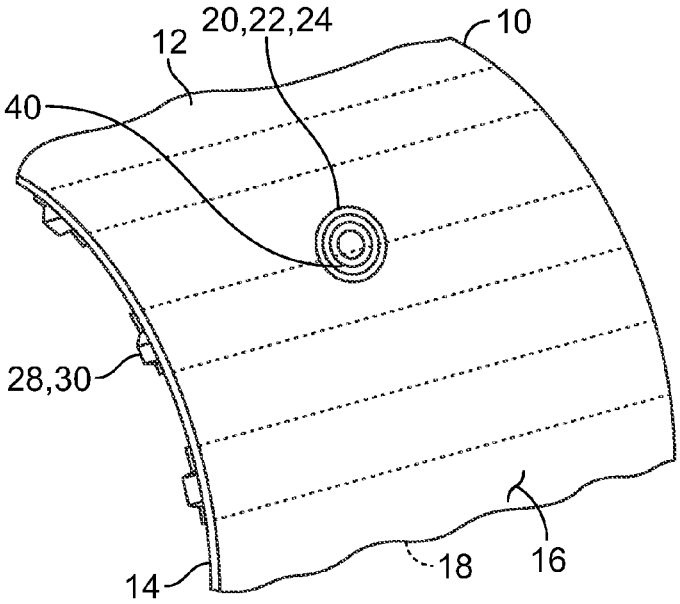
FIG. 1 is a perspective illustration of a composite structure having a rework area formed therein.

Referring now to the drawings wherein the showings are for purposes of illustrating preferred and various embodiments of the disclosure only and not for purposes of limiting the same, shown in FIG. 1 is a perspective illustration of a composite structure 10 upon which a rework process may be implemented using a heating blanket 54 illustrated in FIGS. 2-7. The heating blanket 54 illustrated in FIGS. 2-7 and as disclosed herein may be installed on a patch 40 which may be received within a rework area 20 as illustrated in FIG. 1. The heating blanket 54 as disclosed herein may apply heat to the rework area 20 in order to elevate the temperature of the rework area 20 to a uniform temperature throughout the rework area 20 in order to cure adhesive bonding the patch 40 to the rework area 20 and/or to cure the composite material forming the patch 40. In various embodiments, the heating blanket 54 as disclosed herein incorporates a combination of a plurality of susceptors comprising magnetic materials and high frequency alternating current in order to attain temperature uniformity to a structure 10 to which the heating blanket 54 is applied. In one preferred arrangement, and as will be described in greater detail below, the plurality of susceptors are positioned within a conductor comprising a Litz wire that is wound in a flattened helix (i.e., a solenoid structure). In another preferred arrangement, and as will be described in greater detail below, the plurality of susceptors comprise spring formed susceptors that are positioned around a conductor, such as a Litz wire. Alternative susceptor configurations are also disclosed.

Advantageously, and as will be discussed in greater detail herein, the temperature-dependent magnetic properties such as the Curie temperature of the magnetic materials used in an array of susceptor wires contained within the heating blanket 54 may prevent overheating or under heating of areas to which the heating blanket 54 may be applied. As illustrated herein, an array of susceptor wires comprises an ordered arrangement of at least a first and a second susceptor wire wherein the first and second susceptor wires comprise different magnetic properties, such as the Curie temperature of the magnetic material.

In addition, the susceptor array may comprise a first susceptor comprising a first magnetic material and at least second susceptor. The first susceptor comprises a magnetic material that has a different Curie temperature than a second magnetic material of the second susceptor. In this manner, the combined array of the first and second susceptors of the heating blanket 54 facilitates the uniform application of heat to structures such as composite structures 10 (FIG. 1) during a manufacturing or rework process or any other process where uniform application of heat is required over enhanced temperature ranges. Importantly, the heating blanket 54 comprising an array of susceptor wires wherein the susceptor wires comprise a combination of two or more magnetic materials comprising two or more different Curie temperatures so as to provide for a greater temperature regulation over a wider range of temperatures (e.g., from about 150° F. to about 350° F.).

In addition, the heating blanket 54 compensates for heat sinks 28 (FIG. 1) that may draw heat away from portions of a structure 10 (FIG. 1) to which the heating blanket 54 is applied. More specifically, the heating blanket 54 continues to provide heat to portions of the structure 10 located near such heat sinks 28 while areas underneath the heating blanket 54 that have reached or attained the Curie temperature cease to provide heat to the rework area 20.

Figure 2:
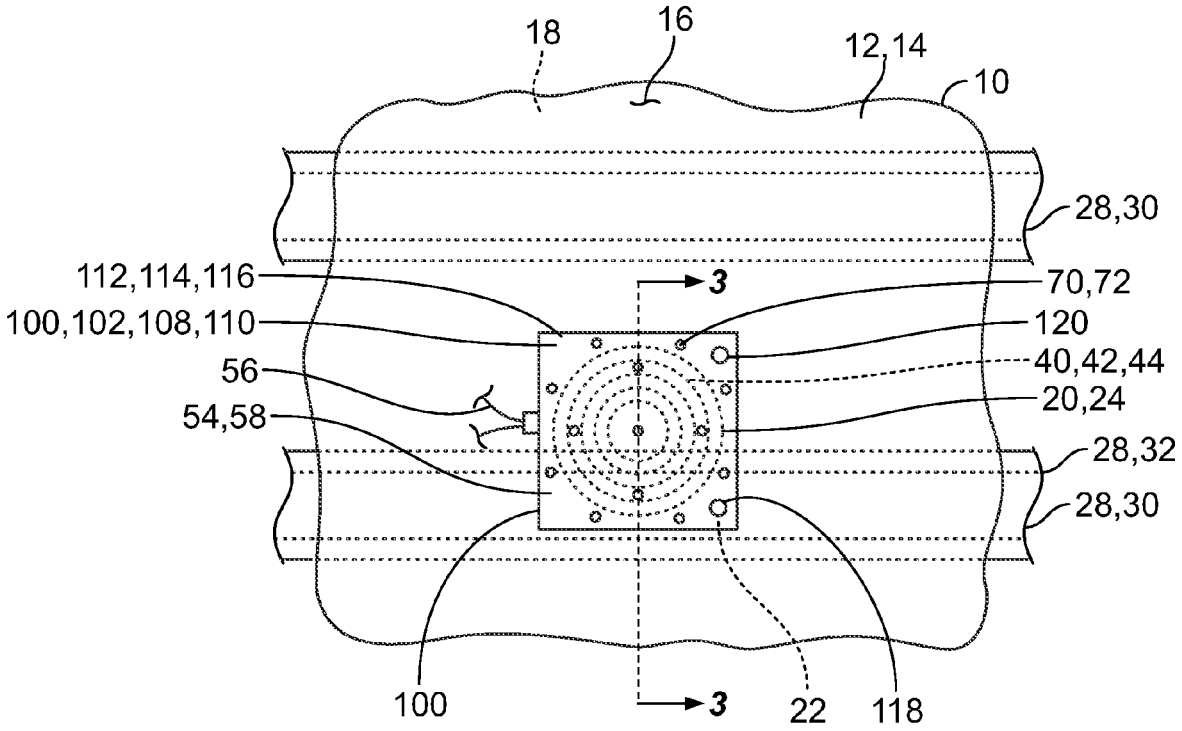
FIG. 2 is a plan view illustration of the rework area of FIG. 1 and illustrating a vacuum bag assembly and a heating blanket applied to the rework area and further illustrating a heat sink comprising a stringer extending along a portion of the rework area on a bottom surfaced of the composite structure.

For example, FIG. 1 illustrates a composite structure 10 which may include a skin 12 formed of plies 14 of composite material and wherein the skin 12 may have upper and lower surfaces 16, 18. The composite structure 10 may include a rework area 20 in the skin 12 formed by the removal of composite material. As can be seen in FIG. 2, the rework area 20 may be formed in the upper surface 16 and may extend at least partially through a thickness of the skin 12 although the rework area 20 may be formed in any configuration through the skin 12. Various structures may be mounted to the lower surface 18 opposite the rework area 20 such as stringers 30 which may act as heat sinks 28 drawing heat away from certain portions of the rework area 20 while the remaining portions continually receive heat from the heating blanket 54 (FIG. 2). Advantageously, the heating blanket 54 (FIG. 2) facilitates the uniform application of heat to the structure 10 by reducing heat input to portions of the rework area 20 that reach approximately the Curie temperature of the magnetic materials in the heating blanket 54 while maintaining a relatively higher level of heat input to portions of the rework area 20 that are below the Curie temperature as will be described in greater detail below. In practice, all areas have some heat losses to the air or surrounding structure and obtain a temperature at which heat losses equal heat input from the blanket. At equilibrium, areas with high heat losses receive more heat from the blanket than areas with low heat losses. This differential heating results in temperature differences across the rework area that is small and that is with typical limits for adhesive bonding.

Figure 3:
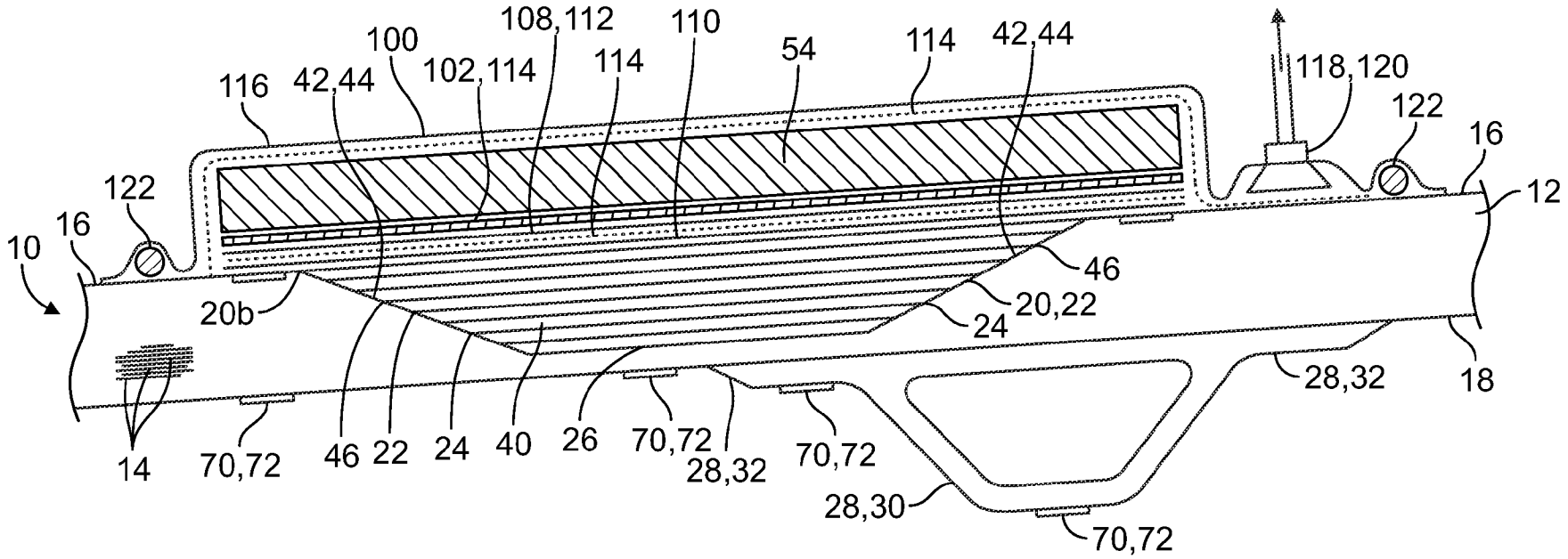
FIG. 3 is a cross-sectional illustration of the composite structure taken along line 3-3 of FIG. 2 and illustrating the stringer (i.e., heat sink) which may draw heat from localized portion of the rework area.

Referring still to FIGS. 2-3, the heating blanket 54 is illustrated as being mounted to the composite structure 10 over the patch 40. A vacuum bag assembly 100 may be installed over the heating blanket 54. The vacuum bag assembly 100 may include a bagging film 116 covering the heating blanket 54 and which may be sealed to the upper surface 16 of the composite structure 10 by means of sealant 122. A vacuum probe 118 and vacuum gauge 120 may extend from the bagging film 116 to a vacuum generator to provide a mechanism for drawing a vacuum on the bagging film 116 for application of pressure and to draw out volatiles and other gasses that may be generated as a result of heating uncured composite material of the patch 40.

As can be seen in FIG. 3, the vacuum bag assembly 100 may include a caul plate 102 positioned above a porous or non-porous parting film 110, 108. The caul plate 102 may facilitate the application of uniform pressure to the patch 40. The porous or non-porous parting film 110, 108 may prevent contact between the caul plate 102 and the patch 40. The vacuum bag assembly 100 may include additional layers such as a bleeder layer 112 and/or a breather layer 114. The patch 40 may be received within the rework area 20 such that a scarf 44 formed on the patch edge 42 substantially matches a scarf 24 formed at the boundary 22 of the rework area 20. In this regard, the interface between the patch 40 and rework area 20 comprises the bondline 46 wherein adhesive is installed for permanently bonding the patch 40 to the rework area 20 and includes adhesive located at the bottom center 26 portion of the rework area 20.

As shown in FIG. 2, thermal sensors 70 such as thermocouples 72 may be strategically located on upper and lower surfaces 16, 18 of the composite structure 10 such as adjacent to the rework area 20 in order to monitor the temperature of such areas during the application of heat using the heating blanket 54. In this regard, thermocouples 72 may be placed on heat sinks 28 such as the stringer 30 body and stringer flanges 32 illustrated in FIG. 3 in order to monitor the temperature of such heat sinks 28 relative to other areas of the composite structure 10.

Figure 4:
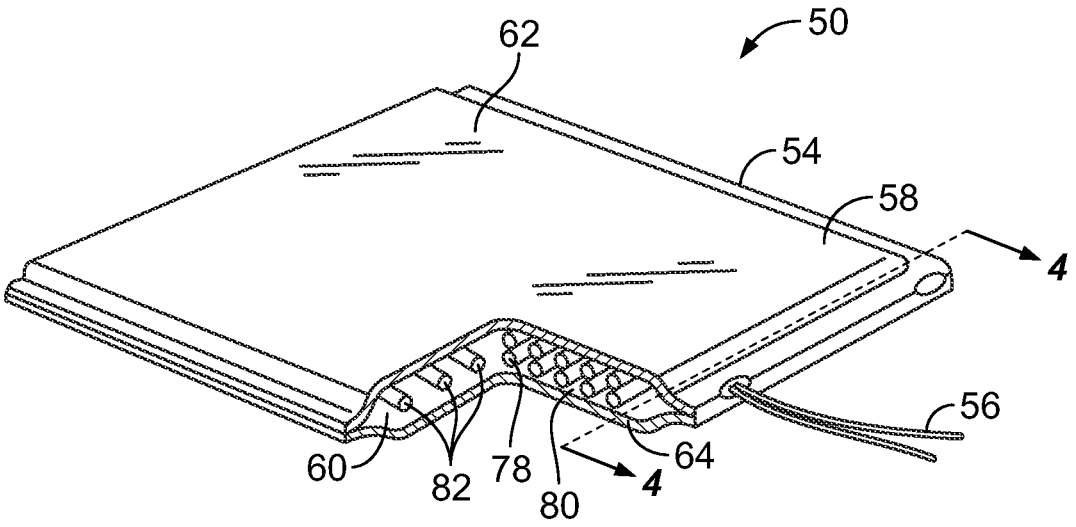
FIG. 4 is a perspective illustration of a heating blanket in an embodiment as may be used for heating the rework area of the composite structure, the heating blanket comprising a flattened helical wire conductor positioned perpendicular to an array of susceptor wires that are positioned within the flattened helical wire conductor.

FIG. 4 is a perspective illustration of a heating blanket 54 in an embodiment as may be used for heating the rework area of the composite structure. The heating blanket 54 comprising a flattened helical wire conductor 80 and an array of susceptor wires 82. Preferably, the array of susceptor wires 82 are arranged within alternating conductors of the helical wire conductor 80 of the heating blanket. More preferably, the array of susceptor wires 82 are arranged perpendicular to the plurality of conductor portions making up the helical wire conductor 80. In one preferred arrangement, the flattened helical wire conductor 80 comprises a Litz wire that is wound in a flattened helical like structure (e.g., a solenoid) so as to define a plurality of alternating conductors.

Figure 5:
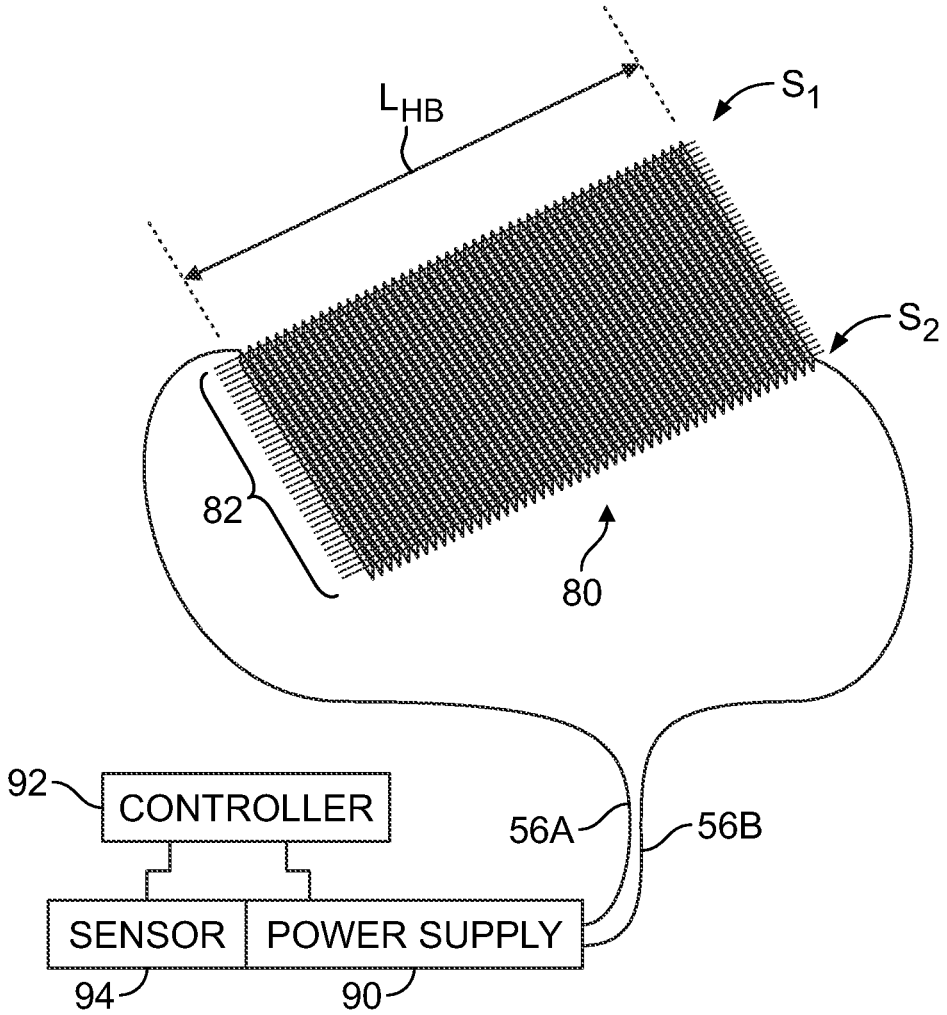
FIG. 5 is a schematic illustration of the heating blanket illustrated in FIG. 4 (with the housing and matrix removed) illustrating the helical wire conductor connected to a power supply, a controller, and a sensor, and with an array of susceptor wires contained within the helical wire conductor.

For example, FIG. 5 is a schematic illustration of the heating blanket 54 illustrated in FIG. 4 (with the heating blanket housing 58 and matrix 78 removed) so as to illustrate the helical wire conductor 80 connected to a power supply 90, a controller 92, and a sensor 94. As illustrated, the helical wire conductor 80 comprises a unitary wire that winds back and forth between a first side $S_1$ of the heating blanket 54 and a second side $S_2$ of the heating blanket in a flattened helical structure, along a length $L_{HB}$ of the heating blanket 54. Importantly, in this illustrated arrangement of the heating blanket 54, the array of susceptor wires 82 are positioned between the alternating conductors or wires making up the helical wire conductor 80 for inductive heating of the array of susceptor wires 82 in the presence of an alternating current provided by the power source 90. The inductively heated array of susceptor wires 82 thermally conducts heat to a matrix 78 (FIG. 4). The matrix 78 may thermally conduct heat to a structure 10 to which the heating blanket 54 is mounted (See, e.g., FIGS. 1-3).

Referring to FIGS. 4 and 5, the heating blanket 54 may include a housing 58 defining an interior 60. This interior may be formed of a suitable material which is preferably thermally conductive and which may also be flexible and/or resilient such that the heating blanket 54 may conform to curved areas to which it may be applied. In this regard, the housing 58 is preferably formed of a pliable and/or conformable material having a relatively high thermal conductivity and relatively low electrical conductivity. The housing 58 may comprise upper and lower face sheets 62, 64 formed of silicone, rubber, polyurethane or other suitable elastomeric or flexible material that provides dimensional stability to the housing 58 while maintaining flexibility for conforming the heating blanket 54 to curved surfaces. Although shown as having a generally hollow interior 60 bounded by the upper and lower face sheets 62, 64, the housing 58 may comprise an arrangement wherein the conductor 80 and the associated magnetic material are integrated or embedded within the housing 58 such that the conductor 80 is encapsulated within the housing 58 to form a unitary structure 50 that is preferably flexible for conforming to curved surfaces.

FIG. 5 illustrates a perspective view of certain components of the heating blanket 54 showing the flattened helical structure of the conductor 80 and the array of susceptor wires 82 residing within this helical structure in greater detail. In one preferred arrangement, and as illustrated in FIG. 5, the susceptor wires 82 are arranged within the helical conductor 80 such that a longitudinal axis of the array of susceptor wires 82 resides substantially perpendicular to an electrical current flowing through the helical conductor 80. In this manner, the varying magnetic fields generated by the helical conductor 80 induce eddy currents in the array of susceptor wires 82 as will be discussed in greater detail herein. In one arrangement, the conductor (80) may be a single conductor. Alternatively, the conductor (80) may comprise an array of parallel conductors in order to reduce the voltage that the power supply must provide to the blanket.

A power supply 90 providing alternating current electric power may be connected to the heating blanket 54 by means of the heating blanket wiring 56 A,B. The power supply 90 may be configured as a portable or fixed power supply 90 which may be connected to a conventional 60 Hz, 110 volt or 220 volt (480 V or higher as necessary to deliver power to very large blankets) outlet. Although the power supply 90 may be connected to a conventional 60 Hz outlet, the frequency of the alternating current that is provided to the conductor 80 may preferably range from approximately 1,000 Hz to approximately 400,000 Hz. In some cases, the frequency of the alternating current that is provided to the conduction 80 may preferably range from approximately 1,000 Hz to approximately 400.00 Hz. In some cases, the frequency of the alternating current provided to the conduction 80 may be as high as 4 MHz. The voltage provided to the conductor 80 may range from approximately 10 volts to approximately 450 volts but is preferably less than approximately 60 volts. Likewise, the alternating current provided to the conductor 80 by the power supply is preferably between approximately 1 amps and approximately 10 amps. In one preferred arrangement, the blanket wire (56) delivers between 1 A and 10 A for a single conductor and between about 2 and 20 A for two parallel conductors and so on for larger number of parallel circuits. In this manner, such parallel circuits can reduce the required voltage provided to the blanket.

Figure 6:
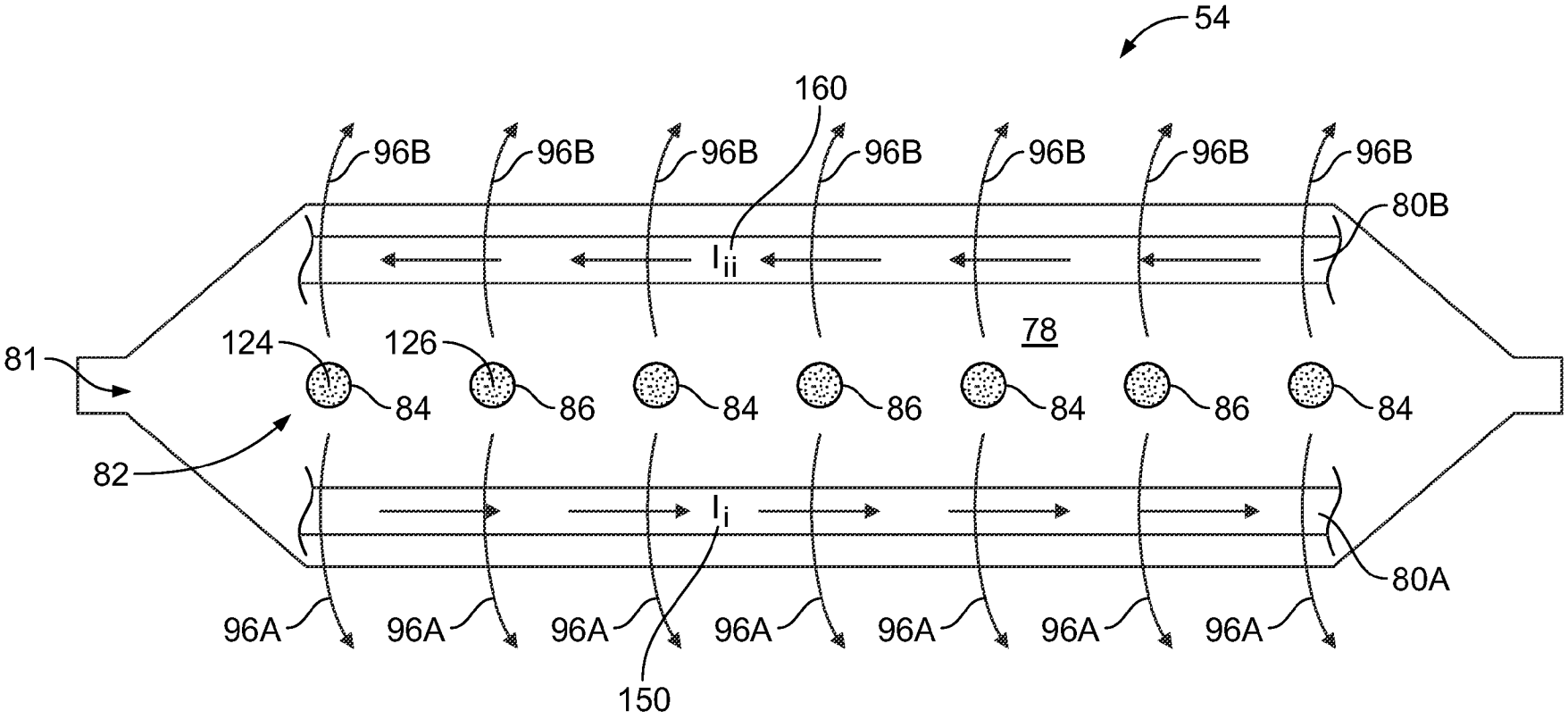
FIG. 6 is a cross-sectional illustration of the heating blanket taken along line 4-4 of FIG. 4 and illustrating the array of susceptor wires provided within the helical wire conductor for induction heating thereof in response to magnetic fields generated by an alternating current applied to the helical wire conductor.

FIG. 6 illustrates a cross sectional view of the array of susceptor wires 82 that may be used with the heating blanket 54 illustrated in FIGS. 2-5 taken along line 5-5 of FIG. 5. As illustrated, the linear array of susceptor wires 82 comprises a first plurality of susceptor wires 84, 86 arranged in at least one row 81. In an alternative linear array arrangement, the linear array of susceptor wires 82 comprises a second plurality of susceptor wires arranged in a second row.

In one preferred arrangement, at least one of the first plurality of susceptor wires within the linear array 82 comprises a magnetic material having a first Curie temperature. In addition, at least one of the plurality of susceptor wires within the linear array 82 comprises a magnetic material having a second Curie temperature, the second Curie temperature being different than the first Curie temperature of the first susceptor wire.

As illustrated in FIG. 6, in one arrangement, the linear array of susceptor wires 82 comprises a plurality of first susceptor wires 84 and a plurality of second susceptor wires 86 within the linear array of susceptor wires 82. Preferably, in one arrangement, the first plurality of susceptor wires 84 comprise a first Curie temperature alloy 124 and the second plurality of susceptor wires 86 comprises a second Curie temperature alloy 126 that is different from the first Curie temperature alloy of the first susceptor wire 124.

As those of ordinary skill will recognize, alternative susceptor array 82 may also be utilized. As just one example, the linear susceptor array 88 may comprise a plurality of third susceptor wires comprising a third Curie temperature alloy. In such an arrangement, the third Curie temperature alloy may be different than the first Curie temperature alloy 124 of the first susceptor wire 84 and also different than the second Curie temperature alloy 126 of the second susceptor wire 86.

In addition, in one exemplary linear array arrangement, the linear array 82 may comprise an equal number of the first susceptor wires 84 and the second susceptor wires 86. In one preferred arrangement, the linear array 82 comprises an unequal number of the first susceptor wires 84 and the second susceptor wires 86. Alternatively, where the linear array 82 further comprises a plurality of third susceptor wires, the number of these third susceptor wires may be same as, greater than or less than the number of first susceptor wires 84. Similarly, the number of third susceptor wires may be same as, greater than or less than the number of second susceptor wires 86. In an alternative arrangement, more of the first or second susceptor wires 84, 86 may be provided. In addition, a diameter size of the first susceptor wires 84, a diameter size of the second susceptor wires 86, and a diameter size of the third susceptor wires may all be the same or may all be different. However, as those of ordinary skill in the relevant art will recognize, alternative sized susceptor wire arrangements may be provided. As just one example, the first susceptor wires 84 may comprise may comprise a 10 mil diameter, the second susceptor wires 86 may comprise 13 mil diameter, and the third susceptor wires may comprise 15 mil diameter. Of course, alternative linear arrangements comprising different wire sizes may also be used.

Increasing the number of different susceptor wire types provided within the linear susceptor array 82 can be beneficial to obtaining an enhanced temperature regulation over an even wider range of operating temperatures.

In one preferred arrangement, the first susceptor conductor 84 comprises a first Curie temperature alloy 124 and the second susceptor conductor 86 comprises a second Curie temperature alloy 128 wherein the second Curie temperature of the second susceptor conductor 86 is a lower temperature than the first Curie temperature alloy of the first susceptor conductor 84. In one preferred arrangement, the first Curie temperature alloy comprises Alloy 34 having 34% Ni and 66% Fe having a Curie temperature point about 450° F. and comprises a negligible magnetic properties above 400° F. In this same arrangement, the second Curie temperature alloy comprises Alloy 32 having 32% Ni and 68% Fe having a Curie temperature of about 392° F. and comprises a negligible magnetic properties above 250° F.

The magnetic fields generated by the alternating current flowing through the helical conductor 80 wound in a Litz wire flattened helix (or solenoid) and inducing eddy currents within the array of susceptor wires 82 will now be described with reference to FIG. 6. As those of ordinary skill in the art recognize, a Litz wire is typically used to carry alternating current and may consist of many thin wire strands, individually insulated and twisted or woven together.

As can be seen as an example in FIG. 6, seven susceptor wires 84, 86 are illustrated and these wire reside in a row, adjacent one another and between two alternating conductors of a helical conductor 80, such as the helical conductor 80 illustrated in FIG. 5. In one preferred helical conductor arrangement, the helical conductor is of unitary construction and comprises a single conductor that is wound from one end of the heating blanket to the other in a continuous, flattened helix shape. As just one example, if the helical conductor comprises a single conductor such as helical conductor 80 illustrated in FIG. 5, this single conductor 80 may make ten (10) turns per inch in the helix.

In an alternative helical conductor arrangement, the helical conductor may comprise two or more conductors forming two or more parallel circuits. Utilizing two or more conductors does not materially affect the generated magnetic field as long as each conductor carriers the same amount of current as the single conductor. With such a multiple conductor helical configuration, the controller 92 and sensor 94 may be operated to adjust and maintain this type of desired current control. One advantage of such a multiple conductor helical configuration is that it acts to reduce the voltage need to provide current from one end of the blanket to the other end of the blanket. For example, instead of having one conductor making ten (10) turns per inch in the helix, the multiple conductor configuration may have, for example, ten (10) conductors making one (1) turn per inch.

Another advantage of such a multiple conductor helical configuration is that it acts to reduce the voltage needed to provide current from one end of the blanket to the other end of the blanket. For example, a separate conductor helical configuration may be utilized to activate a first susceptor conductor whereas a second separate conductor may be utilized to activate a second susceptor conductor. As such, in one exemplary arrangement, under the operation and control of the controller (FIG. 5), different susceptor wires within the susceptor array may be activated at different times or points within the heating process.

Returning to FIG. 6, the linear array 82 comprises a plurality of first susceptor wires 84 having a first Curie temperature 124 and a plurality of second susceptor wires 86 having a second Curie temperature 126. The first Curie temperature being lower than the second Curie temperature. In this illustrated arrangement, the first susceptor wires 84 may be positioned adjacent two of the plurality of second susceptor wires 86. In addition, the susceptor linear array 82 may be positioned an equal distance from both a first, lower conductor portion 80A and a second, upper conductor portion 80B. The susceptor wires are preferably electrically insulated from these conductor portions 80A,B.

Initially, the application of a first alternating current $I_i$ 150 by way of a power source (FIG. 5) to the first conductor portion 80A produces an alternating magnetic field lines 96A that comprise concentric circles around the cylindrically current carrying conductor 80A. In FIG. 6, these concentric circles 96A may be illustrated as comprising a first magnetic field 96 which is illustrated as directed perpendicularly out of the paper. Similarly, the application of a second alternating current $I_i$ 160 (flowing in an opposite direction as the first alternation current $I_i$ 150) through the second conductor portion 80B produces an alternating magnetic field lines 96B that comprise concentric circles around the cylindrically current carrying conductor 80B.

Because of the orientation of the first and second magnetic fields 96A,B, these fields 96A,B will essentially cancel each another out on the outside of the blanket 54, below the first conductor 80A as they reside in opposite directions. Similarly, above the second or upper conductor 80B on the outside of the blanket 54, the first and second magnetic fields 96A,B will also essentially cancel one another out. In contrast, within the heating blanket matrix 78 and hence within the susceptor linear array 82, the first and second magnetic fields 96A,B will be additive to one another since both fields are oriented substantially parallel to the axis of the susceptor wires linear array 82. This substantially parallel combined oscillating magnetic field 96A,B will therefore generate eddy currents that travel circumferentially within the susceptors 84, 86 contained within the susceptor array 82. Therefore, both the susceptors 84, 86 will generate heat simultaneously with the application of the magnetic fields 96A,B.

Initially, the concentration of the magnetic fields 96A,B results in relatively large eddy currents generated in the plurality of first susceptor wires 84 having the lower Curie temperature as well as eddy currents generated in the plurality of second susceptor wires 86 having the higher curie temperature. As illustrated, eddy currents are generated in both the lower and higher Curie temperature materials 84, 86 as long as a susceptor has high permeability and is of sufficient diameter so that the skin depth is substantially smaller than the wire radius. In the present disclosure, and in this illustrated arrangement, the second susceptor does not dominate heating at low temperature by having a smaller concentration of the second susceptor than the first. The induced eddy currents in both the first and second materials result in resistive heating of the first and second susceptor wires 84 and 86. Although most of the heating is provided by way of the lower Curie temperature material, the eddy currents within the higher Curie susceptor 86 will also provide a certain amount of resistive heating at lower temperatures, albeit less than the heat generated by way of lower Curie temperature susceptor 84. As such, the first susceptor wire 84 and the second susceptor wire 86 both act to conductively heat the matrix 78 and the structure 10 in thermal contact with the heating blanket 54. (FIGS. 5-6) The heating of the first susceptor wire 84 and second susceptor wire 86 continues during application of the alternating current until the magnetic material of the first susceptor wire 84 approaches its Curie temperature, which again in this illustrated arrangement is lower than the Curie temperature of the second susceptor wire 84.

Upon approaching the temperature where the magnetic properties of the first susceptor wire 84 becomes negligible, the first susceptor wire 84 becomes non-magnetic. At this non-magnetic point, the magnetic fields 96A,B generated by the first conductor portion and the second conductor portion 80A,B continue to generate eddy currents in the higher Curie temperature susceptor because it is still electrically conductive due to its higher Curie temperature. As such, once the lower Curie temperature of the first susceptor wire 84 is achieved, temperature regulation by way of both the first susceptor wire 84 and the second susceptor wire 86 continue, albeit at a higher Curie temperature.

As the first susceptor wire 84 no longer generates heat, the concentration of the magnetic field 96B continues to generate large eddy currents in the second susceptor wire 86. The continued induction of eddy currents within both the first and second susceptor wire 86 result in resistive heating of the second susceptor wire 86. The first and second susceptor wire 86 therefore continue to conductively heat the matrix 78 and the structure 10 in thermal contact with the heating blanket 54 (FIG. 3). The heating of the susceptor wire 86 continues during application of the alternating current $I_i$ 150 and $I_{ii}$ 160 until the magnetic material of the susceptor wire 86 approaches its Curie temperature, which again in this illustrated arrangement comprises a higher Curie temperature than the Curie temperature of the first susceptor wire 84. Upon reaching the higher Curie temperature of the second susceptor wire 86, the susceptor wire 86 becomes non-magnetic. At this non-magnetic point, the magnetic fields 96A,B are no longer concentrated in the susceptor wire 86. The induced eddy currents and associated resistive heating of the susceptor wire 86 therefore diminishes to a level sufficient to maintain the temperature of the first and second susceptor wire 86 at the higher Curie temperature.

Figure 7:
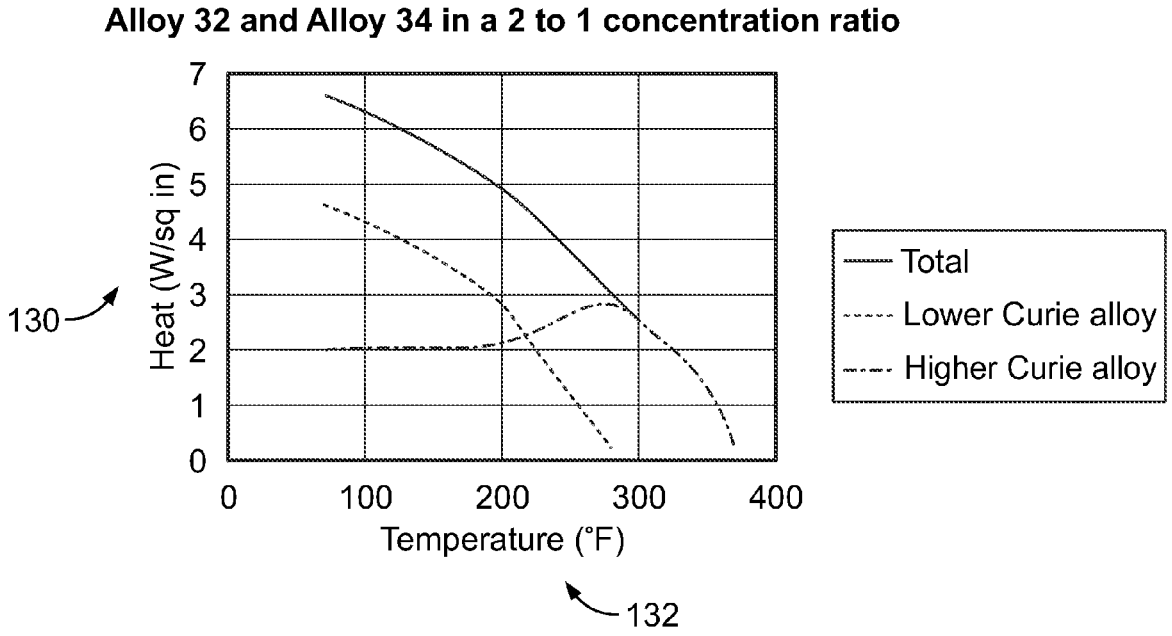
FIG. 7 an illustration of a plot of heat output measured over temperature for an embodiment of an exemplary array of susceptor wires.

As an example of the heating of the magnetic material to the Curie temperature, FIG. 7 illustrates a plot of heat output 130 measured over temperature 132 for an exemplary heating blanket comprising an array of susceptors as disclosed herein. Specifically, the heating blanket may comprise an array of susceptors mounted within a conductor 80 wherein the conductor 80 comprises a Litz wire formed as a flattened helix as illustrated in FIG. 5. To generate the data presented in this graph, the array of susceptors comprise a 2:1 mixture of a first plurality of first susceptor wires comprising Alloy 32 and a second plurality of second susceptor wires Alloy 34, wherein each of the first and second wires comprised a 10 mil diameter. Both first and second susceptor wires were inductively heated by way of a 300 KHz magnetic field whose amplitude was increased from 5 Oe to 10 Oe as the temperature rises to compensate for increasing heat losses that occur at higher temperature. The first plurality of first susceptor wires comprised a susceptor wire comprising a 10 mil diameter Alloy 32 (32% Ni and 68% Fe). The second plurality of second susceptor wires comprised a susceptor wire comprising a 10 mil diameter Alloy 34 (34% Ni and 66% Fe) wire. In this susceptor wire arrangement, the susceptor array comprises a 12 mil center-to-center spacing. As those of ordinary skill in the art will recognize, alternative diameter sizes and center-to-center spacing configurations may also be utilized. As can be seen in FIG. 7, this susceptor arrangement provided an extended useful temperature range for such a susceptor including a controlled temperature range from about 150° F. to about 380° F. It should be noted that typically, in certain applications, more heat is needed to compensate for higher heat losses at higher temperatures as those temperatures illustrated in FIG. 7. In order to provide the required increase in heat, the current and therefore the magnetic fields may be increased as necessary by increasing the power supply current. This increase in current will effectively shift the curve in FIG. 7 upward so as to provide a desired amount of heat while still maintaining the same negative slope curve shape while providing a greater amount of heat to cooler areas, such as those located near heat sinks. (See e.g., heat sink 28 and FIG. 1).

The high frequency electric current provided to the helical conductor illustrated in FIG. 5 may generate certain undesired consequences. For example, high frequency electric current flowing through such a flattened helical conductor may induce unwanted heating in conductive materials that might reside in the near vicinity to the heating blanket 54. Such undesired heating may occur in metal tooling and graphite composite structures. As just one example, the high frequency electric current flowing through the flattened helical conductor illustrated in FIGS. 5 and 6 may produce unwanted heating in nearby conductive material. As described herein, this induced unwanted heating is absent above and below the solenoid portion of the heating blanket since the magnetic fields produced from the current traveling in opposite directions (e.g., current traveling within the upper and lower Litz wires in the heating blanket) nearly cancel each other out as discussed herein in greater detail, for example with reference to FIG. 6.

In addition, if the heating blanket conductor is in the form of a spiral as the conductor arrangement illustrated in FIGS. 5 and 6 with the income power lead 56A and outgoing power lead 56B located at separate ends of the solenoid conductor 80, then there is also a net current flowing (in this illustrated arrangement) from left to right that is not cancelled. As such, the alternating input current flowing through the first power lead 56A and the alternating output current flowing through the second power lead 56B do not cancel one another. Also, the spiral or helical orientation of the various conductor wires making up the helical conductor 80 can also induce unwanted axial currents in the susceptor wires 82 residing within the helical conductor 80.

Consequently, there is a need for an enhanced wire conductor arrangement for use with a heating blanket (such as the heating blanket illustrated in FIGS. 2-4) that avoids or reduces unwanted or undesired induction heating. Such an enhanced wire conductor reduces unwanted heating of composite structures, tends to cancel alternating currents in the first and second power leads of the heating blanket, and tends to reduce unwanted axial currents in susceptor wires positioned between alternating conductors of the wire conductor.

Figure 13:
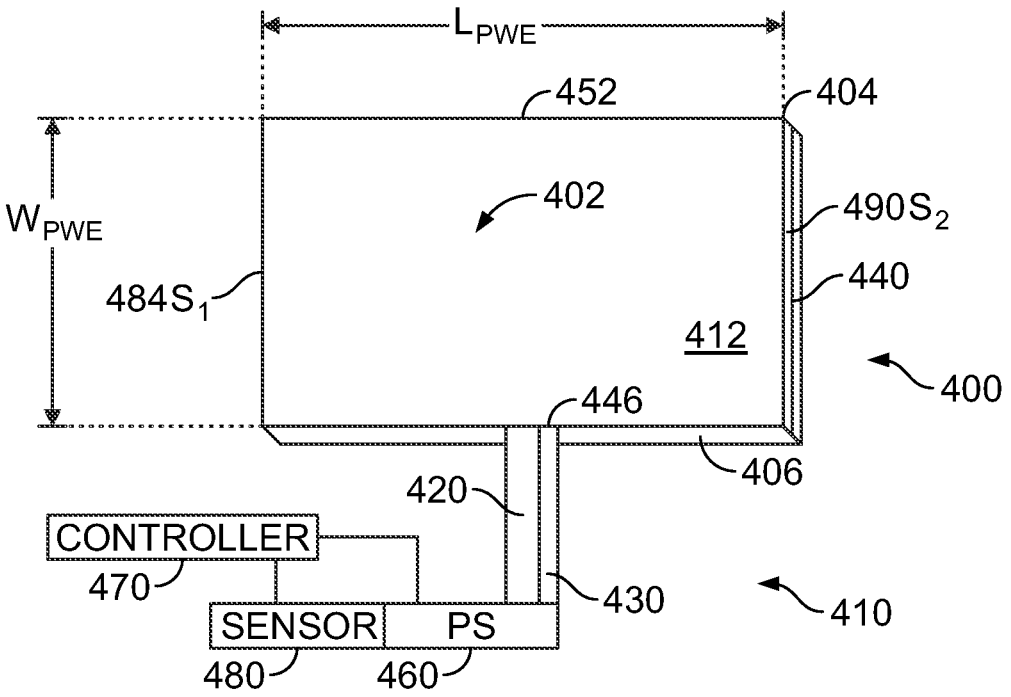
FIG. 13 is a schematic illustration of a heating blanket, similar to the heating blanket illustrated in FIG. 4, with the heating blanket housing and matrix removed.

FIG. 13 is a schematic illustration of a heating blanket 410, similar to the heating blanket 54 illustrated in FIG. 4 (with the heating blanket housing and matrix removed). The heating blanket 410 comprises a parallel wire conductor 400 that is operably connected to a power supply 460, a controller 470, and a sensor 480. As illustrated, the parallel wire conductor 400 comprises a plurality of wires 402 configured in a generally serpentine parallel configured circuit 404. This generally serpentine parallel configured circuit 404 enters the parallel conductor 400 along the first power lead 420, extends along a first edge 446 of the first/bottom conductor layer, towards a first side $S_1$ 484 of the parallel wire conductor 400.

The parallel configured circuit 404 serpentines then back and forth first along the bottom conductor layer 406 from the first edge 446 of the parallel wire conductor 480 and the second edge 452 of the parallel wire conductor 400. In this illustrated arrangement, the parallel wire conductor 400 comprises a plurality of Litz wires (e.g., parallel wire conductor comprises ten (10) Litz wires) forming the parallel configured circuit 404. Generally, this parallel circuit 404 serpentines between the top and bottom of the parallel wire conductor layers 412, 406, and then exits out of the output power lead 430. However, as those of ordinary skill in the relevant art will recognize, alternative parallel circuit arrangements may also be utilized.

This alternative wire conductor arrangement 400 comprises a parallel wire conductor comprising a first or bottom layer 406 comprising a plurality of parallel conductors 408. The parallel wire solenoid further comprises a second or top layer 412 comprising a plurality of alternating parallel conductors 414. Similar to the helical wire conductor arrangement illustrated in FIG. 5, the first power lead 420 and the second power lead 430 operatively coupled to a power supply 460, a controller 470, and a sensor 480. Where the parallel wire conductor 400 is used as part of a heating blanket, an array of susceptor wires 440 (as discussed herein) is positioned within the parallel wire conductor 400, residing between parallel conductors 408 of the first/bottom layer of conductor 406 and the alternating parallel conductors 414 of the second/top layer 412, similar to the alternating conductor arrangement illustrated in FIGS. 4-6.

Figure 14:
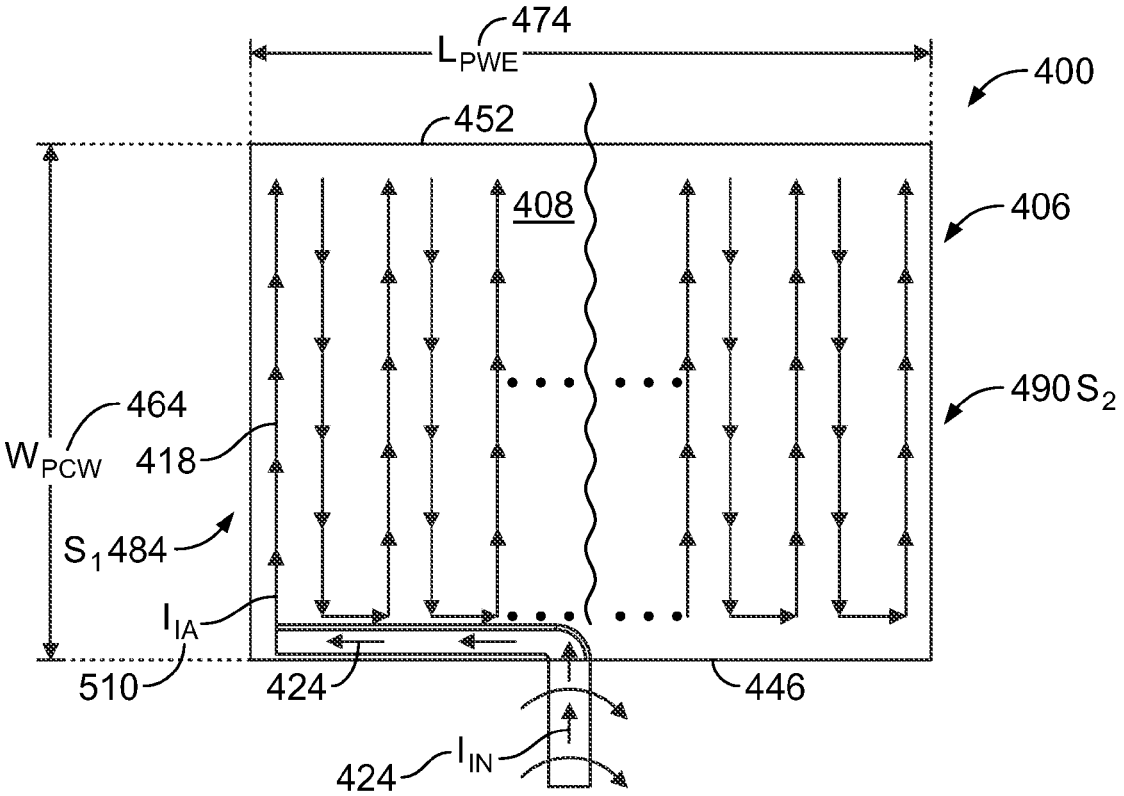
FIG. 14 illustrates a schematic illustration of a bottom or first layer of the parallel wire conductor of the heating blanket illustrated in FIG. 13.

FIG. 14 is a schematic illustration of the first/bottom 406 of the parallel wire conductor 400 illustrated in FIG. 13. Specifically, FIG. 14 illustrates the plurality of bottom layer conductors 408 of the parallel wire conductor 400. Also illustrated in FIG. 14 is the direction of the alternating current $I_{1A}$ 510 flowing through a first plurality of parallel wires 418 in the bottom layer 406 of the parallel wire conductor 400.

Figure 15:
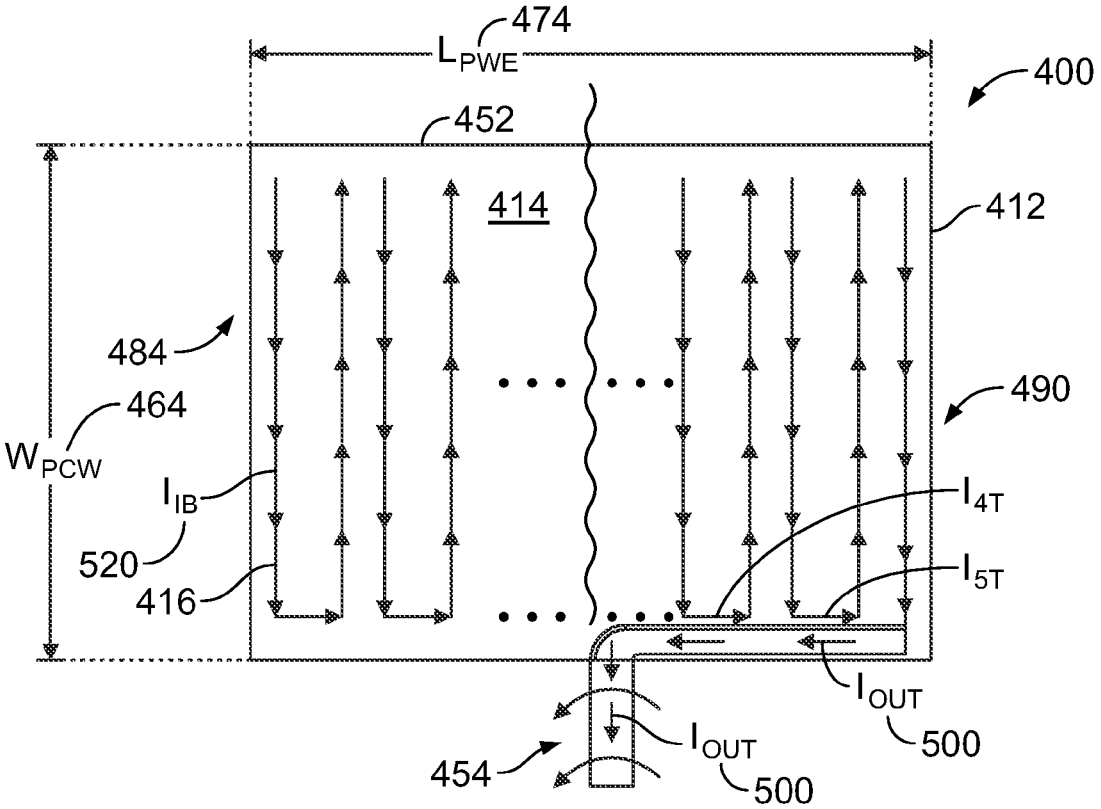
FIG. 15 illustrates a schematic illustration of a top or second layer of the parallel wire conductor illustrated in FIG. 13.

Similarly, FIG. 15 is a schematic illustration of the second/top layer conductors 414 illustrated in FIG. 13. Also illustrated in FIG. 15 is the direction of the alternating current $I_{1B}$ 520 flowing through a first plurality of parallel wires 416 in the top layer 414 of the parallel wire conductor 400.

Referring now to FIGS. 13-15, the incoming alternating current $I_{IN}$ 424 flows within a grouping of (10) ten parallel Litz wires configured to first enter the parallel wire conductor 400 along the first edge or a translation edge 446 of the parallel wire conductor 400. As will be described in greater detail below, the first edge or the translation edge 446 of the parallel wire conductor 400 is the edge of the parallel wire conductor 400 where the plurality of conductors are translated 180 degrees. This 180 degree translation preferably occurs in two steps. First, the plurality of conductors are translated 90 degrees so that the conductors are re-directed towards the second side 490 of the parallel wire conductor 400. In a second translation step, the plurality of conductors are translated a second 90 degrees so that they are now directed back towards the second edge 452 of the parallel wire conductor 400.

As may be seen from FIG. 13, in this illustrated parallel wire conductor arrangement 400, the first or the incoming power lead 420 resides immediately adjacent a second power lead or an outgoing power lead 430. Incoming alternating current $I_{IN}$ 424 is provided by way of the power supply 460 (FIG. 14) to the parallel wire conductor by way of the first or the incoming power lead. Outgoing alternating current designated generally by $I_{OUT}$ 500 (see, e.g., FIG. 16) exists the parallel wire conductor 400 by way of the outgoing power lead 430. More preferably, in one conductor arrangement, the first or the incoming power lead 420 resides either immediately above or immediately below the second or the outgoing power lead 430.

As illustrated, incoming alternating current $I_{IN}$ 424 enters the parallel wire conductor 400 by way of the incoming power lead while the outgoing current $I_{OUT}$ 500 exits the parallel wire conductor 400 by way of the outgoing power lead 430. Incoming alternating current $I_{IN}$ 424 flowing through the first or incoming power lead 420 generates a first magnetic field 426 as illustrated in FIG. 14. This first magnetic field 426 is illustrated as entering the page on the left of the first power lead 420 and exiting the page on the right side of the power lead 420.

Referring back to FIG. 14, after entering the parallel wire conductor 400, the plurality of conductor wires extend along the first edge 446 of the parallel conductor 400. The plurality of parallel wires then turns towards the first side $S_1$ 484 of the parallel conductor 400. The plurality of conductors then proceeds in a parallel configuration towards the second edge 452 of the parallel conductor 400. At this second edge 452, and as illustrated in FIG. 14, the ten parallel wires extend along an entire width $W_{PWC}$ 464 of the parallel conductor 400, starting from a first edge and extending in a parallel fashion towards the a second edge 452, along the bottom/first layer 406 of the parallel wire conductor 400. As such, the plurality of wires carry a first alternating current $I_{1A}$ 510 travels along the entire width $W_{PWC}$ of the parallel conductor from the first edge 446 and to the second edge 452 along the bottom layer 406 of the parallel wire conductor.

Figure 16:
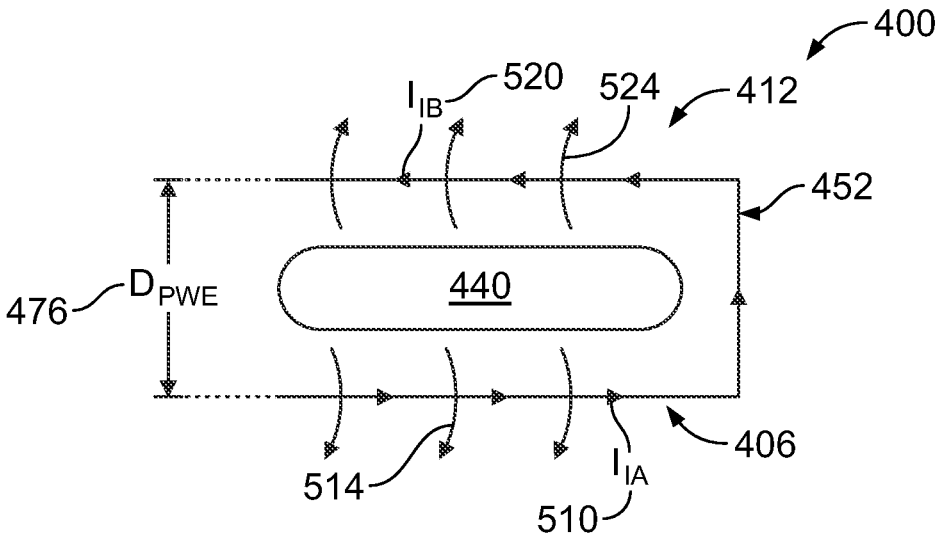
FIG. 16 illustrates a first plurality of wires in the bottom/first layer and in the top/second layer of the parallel wire conductor illustrated in FIGS. 14-15.

FIG. 16 illustrates a close up view of the plurality of wires nearing the second edge 452 of the parallel wire conductor 400. As illustrated, once at the second edge 452 of the parallel wire conductor 400, the plurality of parallel wires extend upwards a certain desired distance $D_{PC}$ 476 from the bottom layer 406 of the parallel wire conductor 400 (FIG. 14) towards the top layer 412 of the parallel wire conductor 400 (FIG. 15). Preferably, the plurality of parallel wires extend upwards the certain desired distance $D_{PC}$ 476 from the bottom layer 406 of the parallel wire conductor 480 (FIG. 14) towards the top layer 412 of the parallel wire conductor 480 (FIG. 15). Distance $D_{PC}$ 476 may be chosen based on an overall height of the matrix and the type of susceptor arrangement provided in between the first and second layers 406, 412 of the parallel wire conductor 400.

The first collection of parallel wires residing along the top layer 412 of the parallel wire conductor 400 are positioned parallel with and directly above the first collection of parallel wires extending along the bottom layer 406 of the parallel wire conductor 400 back towards the first edge 446 of the parallel wire conductor 400. As described above with reference to FIGS. 4 and 5, a plurality of susceptors 440 provided are within the parallel wire conductor and are preferably positioned in between these collections of parallel wires residing along the top layer 412 and residing along the bottom layer 406 of the parallel wire conductor 400. One advantage of such a parallel wire configuration is that the first current $I_{1A}$ 510 flowing through the first collection of wires flows from the first conductor edge 446 to the second conductor edge 452 while this same current designated by $I_{1B}$ 520 in FIG. 16 flows through the first collection of wires along the top layer 412. Currents $I_{1A}$ and $I_{1B}$ are directly opposite one another. As such, the magnetic field 514 generated by the first current $I_{1A}$ 510 flowing in the first plurality of conductors along the bottom conductor layer 406 will cancel out the magnetic field 524 generated by the corresponding current $I_{1B}$ 520 flowing in an opposite direction along the first collection of wires along the top conductor layer 412 of the parallel conductor 400.

Importantly, in this illustrated arrangement of the parallel wire conductor, the plurality of susceptor wires 440 are positioned between the alternating conductors or wires making up the parallel wire conductor 400 for inductive heating of the plurality of susceptor wires 440 in the presence of the incoming alternating current 424 provided by the power supply 460. The inductively heated plurality of susceptor wires 440 thermally conducts heat to a corresponding heating blanket matrix (see, e.g., matrix 78 in FIG. 4).

As the plurality of wires nears the first/translation edge 446 of the parallel wire conductor 400, the plurality of wires must now be translated 180 degrees so that plurality of wires maintain their parallel orientation but must now be directed back towards the second edge 452 of the conductor 400. As such, the plurality of wires need to be directed in a parallel and uniform orientation back along the top layer 412 and towards the second edge 452 of the parallel conductor wire 400.

Figure 17:
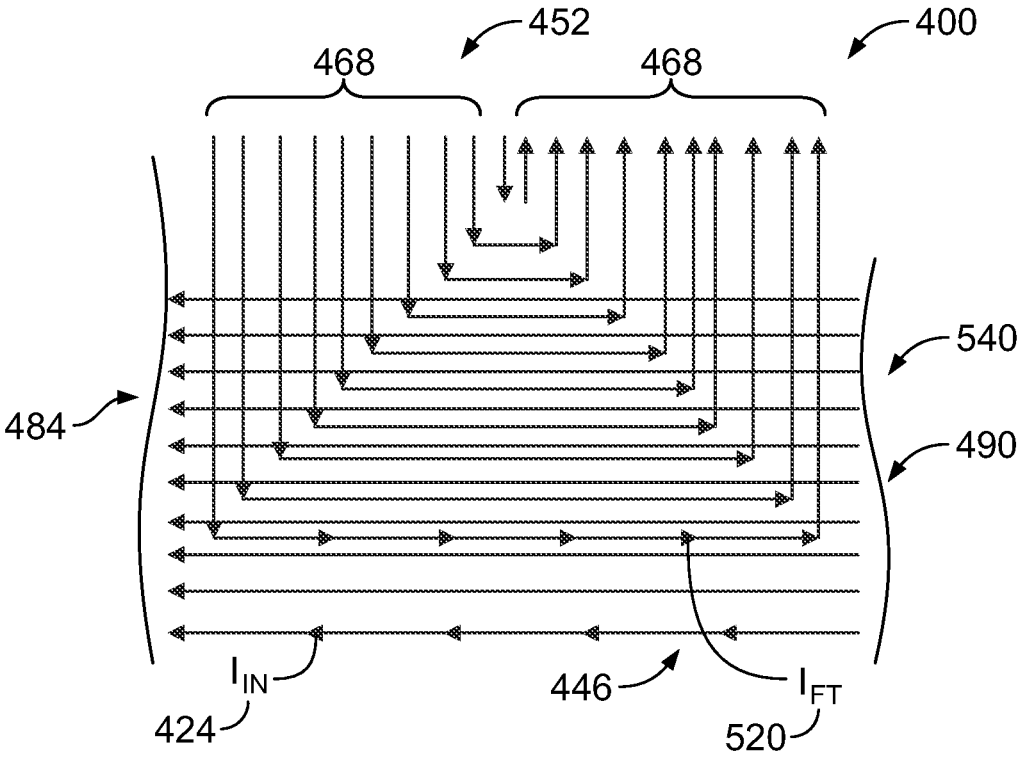
FIG. 17 illustrates a close up view of a plurality of conductor wires approaching a first edge or translation edge of the parallel wire conductor illustrated in FIGS. 14-15.

FIG. 18 illustrates a close up view of a plurality of conductor wires 468 approaching the first edge or translation edge 446 of the parallel wire conductor 400 illustrated in FIGS. 13-15. Specifically, FIG. 17 illustrates one conductor wire arrangement for translating or turning the plurality of wires 468 that are originally oriented towards the first conductor edge 446 of the parallel wire conductor 400, back towards the second edge 452 of the parallel wire conductor 400. As illustrated in FIG. 17, the plurality of conductor wires 468 are initially directed towards the first edge 446 of the parallel wire conductor 400. As the plurality of wires approach the first edge 446, the wires initially undergo a first 90 degree turn 530 back towards the second side $S_2$ 490 of the parallel wire conductor 400. As such, current $I_{FT}$ 520 flowing along this first turn of the plurality of wires 468 will be now be directed in an opposite direction to the input current $I_{IN}$ 424 that is initially flowing along the first edge 446 of the bottom conductor layer 406 of the parallel conductor wire 400 (see, e.g., FIG. 14).

After this first 90 degree turn 530, and to now allow the first plurality of conductors 468 to run back towards the second edge 452 of the parallel wire conductor 400, the plurality wires 468 undergo yet a second 90 degree turn 540.

Consequently, after this second turn 540, the plurality of wires 468 are now directed back towards the second edge 452 of the parallel wire conductor 400, and oriented parallel to the first parallel collection of wires.

This pattern of two 90 degrees turns is repeated along the entire length $L_{PWC}$ 474 of the parallel wire conductor 400 with the plurality of wires 468 traversing between the top and bottom conductor layers 412, 406 and back forth between the first and second edges 446, 452 of the parallel wire conductor 400. Once the plurality of conductor wires reach the second side 490 of the parallel wire conductor 400, the plurality of conductors 468 will run back along the first edge 446 of the parallel wire conductor 400 towards the first conductor side $S_1$ 484 and towards the output power lead 430. Consequently, the output alternating current $I_{OUT}$ 500 will flow along the top or second layer 412 in the direction as noted in FIG. 16: from the second side 490 of the conductor 400 towards the first side 484 of the conductor 400. The output current $I_{OUT}$ 500 will be flowing in an opposite direction as the current flowing in the fourth turn $I_{4T}$ and the current flowing in the fifth turn $I_{5T}$ as illustrate in FIG. 15. As such, a magnetic field 504 generated by the output current $I_{OUT}$ 500 will cancel the magnetic fields generated by the currents flowing through the fourth turn $I_{4T}$ and the current flowing in the fifth turn $I_{5T}$.

The parallel wire conductor 400 as illustrated in FIGS. 13-17 offers a number of advantages. For example, the parallel wired conductor 400 when incorporated in to heating blanket as described here tends to reduce unwanted heating of nearby conductive materials, such as metal tooling and graphite composite structures. In addition, the parallel wire conductor 400 also tends to cancel the alternating currents in the first and second power leads 420, 430 of the parallel wire conductor 400. Moreover, the parallel wire conductor further reduces unwanted axial currents in the susceptor wires positioned between the alternating conductor bottom and top layers 406, 412.

Returning now to FIG. 8, FIG. 8 is an illustration of an alternative susceptor and conductor arrangement 200 that may be used in a heating blanket, such as the heating blanket 54 illustrated in FIGS. 2-4 or the heating blanket 410 illustrated in FIG. 13. In this illustrated alternative arrangement 200, the susceptor 210 comprises a spring shaped susceptor and is wound around a conductor 220. In one preferred arrangement, the susceptor 210 comprises a first and second susceptor wire arrangement as describe and illustrated herein. In an alternative preferred arrangement, the susceptor 210 comprises a first, a second, and a third susceptor wire arrangement as described and illustrated in FIG. 6, however alternative susceptor arrangements may also be utilized.

Figure 8:
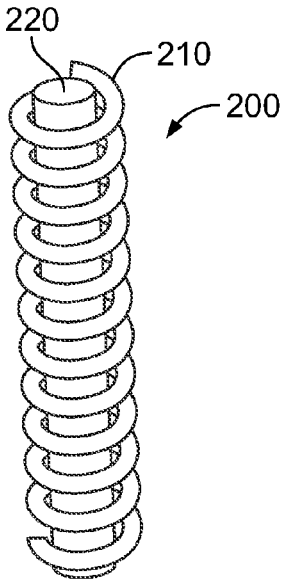
FIG. 8 is an illustration of an alternative susceptor and conductor arrangement that may be used in a heating blanket, such as the heating blanket illustrated in FIGS. 2 and 3.
Figure 9:
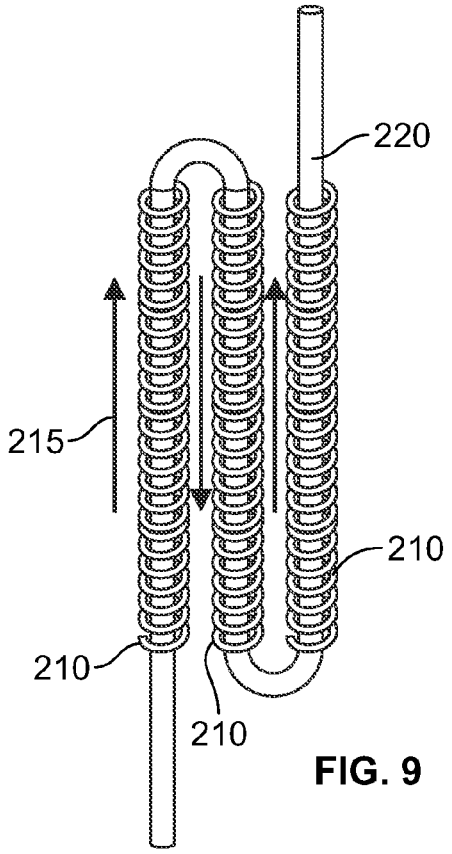
FIG. 9 is an illustration of an alternative heating blanket layout of the alternative susceptor and conductor arrangement illustrated in FIG. 10.
Figure 10:
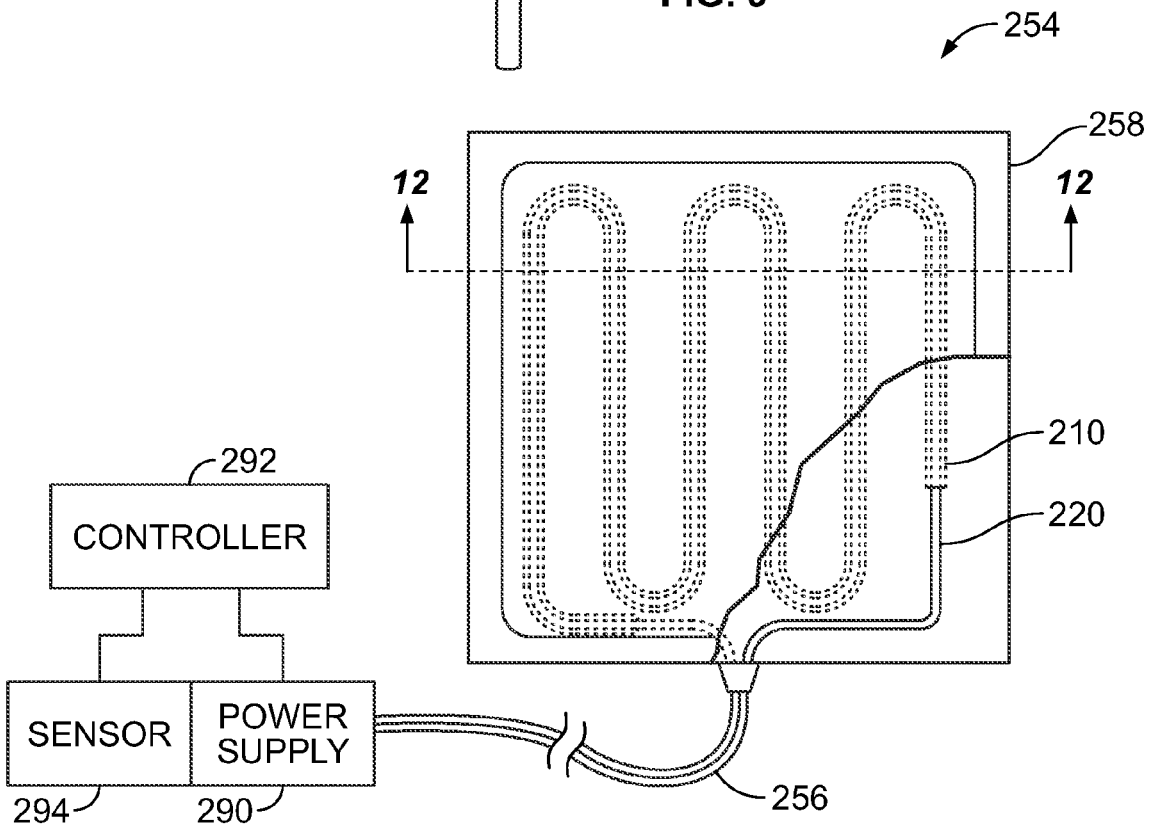
FIG. 10 is a schematic illustration of an alternative heating blanket connected to a power supply, a controller and a sensor and illustrating the susceptor and conductor arrangement illustrated in FIG. 9 housed within a housing of the heating blanket.

FIG. 9 is an illustration of an alternative layout of the alternative susceptor and conductor arrangement illustrated in FIG. 8. And FIG. 10 illustrates a top view of an alternative heating blanket arrangement 254 showing the meandering pattern of the conductor 220 and the array of susceptor wires 210 within the housing 258. In one preferred arrangement, the array of susceptor wires 210 comprise spring formed wires as illustrated in FIG. 8. Such susceptor wires 210 may be wound around the conductor 220 such that a longitudinal axis of the array of susceptor wires 210 is substantially perpendicular to an electrical current flowing through the conductor 220 and generating a magnetic field parallel to the longitudinal axis of the susceptor wires 210. In this manner, a varying magnetic field generated by the conductor 220 induces eddy currents in the array of susceptor wires 210 as discussed in greater detail herein.

A power supply 290 providing alternating current electric power may be connected to the heating blanket 254 by means of the heating blanket wiring 256. The power supply 290 may be configured as a portable or fixed power supply 290 which may be connected to a conventional 60 Hz, 110 volt or 220 volt (or 480V for very large blankets) outlet. Although the power supply 290 may be connected to a conventional 60 Hz outlet, the frequency of the alternating current that is provided to the conductor 220 may preferably range from approximately 1000 Hz to approximately 400, 000 Hz (or up to 2 MHz as described above). The voltage provided to the conductor 220 may range from approximately 10 volts to approximately 450 as described above volts but is preferably less than approximately 60 volts. Likewise, the frequency of the alternating current provided to the conductor 220 by the power supply is preferably between approximately 1 A and 10 A as described above. In this regard, the power supply 290 may be provided in a constant-current configuration wherein the voltage across the conductor 220 may decrease as the magnetic materials within the heating blanket 254 approach the Curie temperature at which the voltage may cease to increase when the Curie temperature is reached as described in greater detail below.

Figure 11:
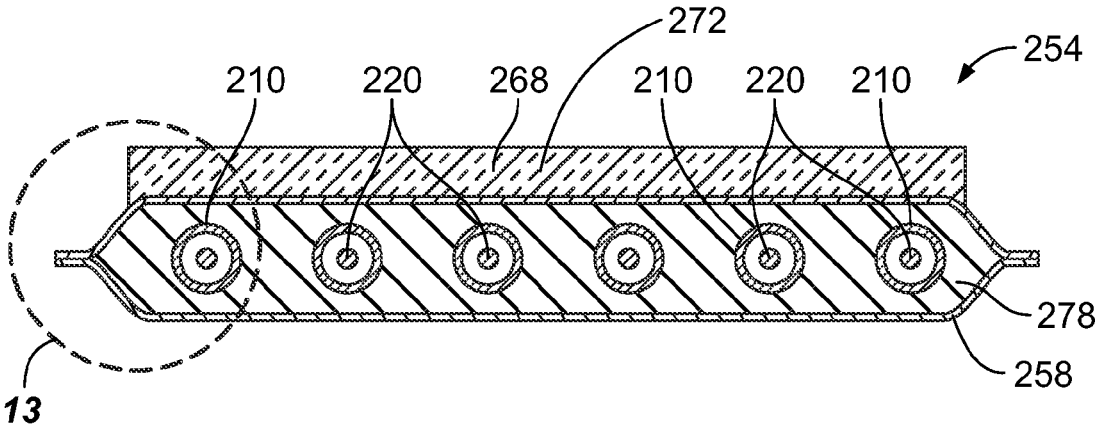
FIG. 11 is a cross-sectional illustration of the heating blanket taken along line 10-10 of FIG. 10 and illustrating the conductor provided with a plurality of susceptor wires spirally surrounding the conductor for induction heating thereof in response to a magnetic field generated by an alternating current applied to the conductor.
Figure 12:
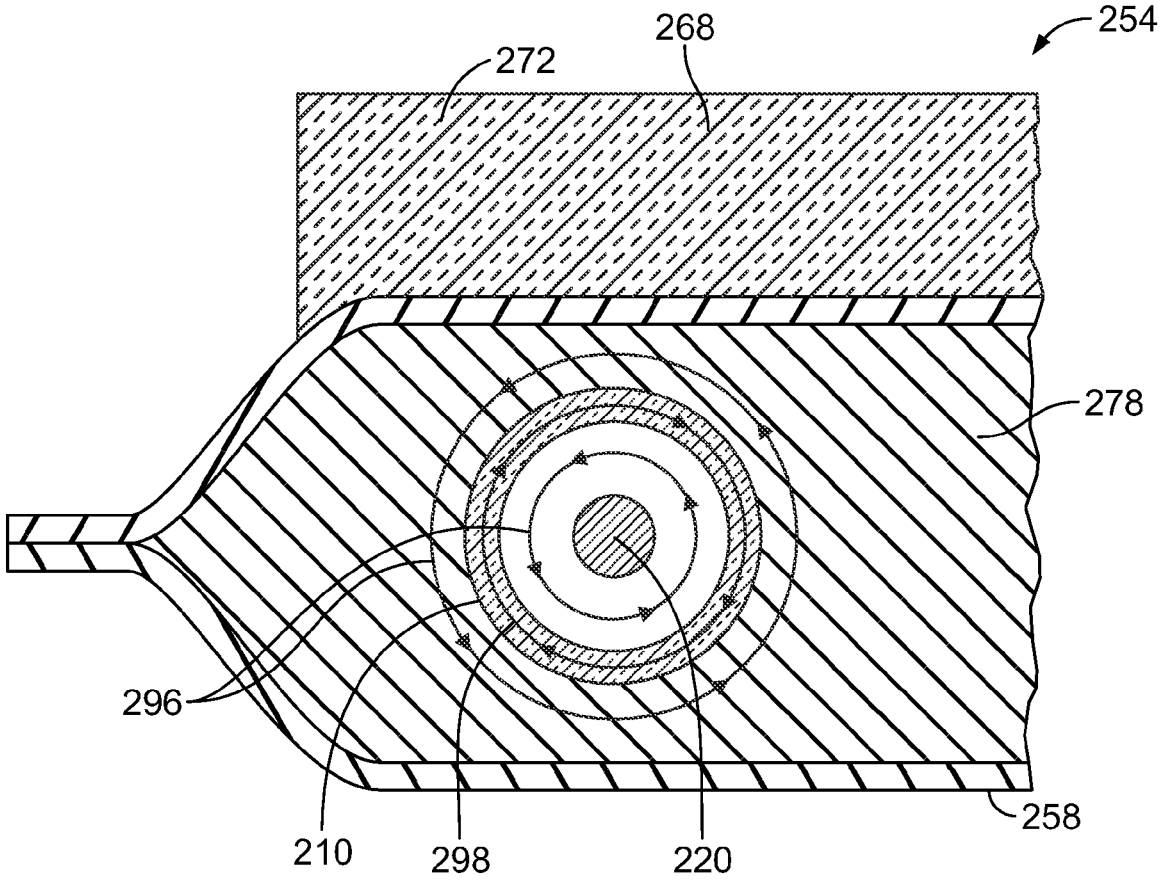
FIG. 12 is an enlarged sectional illustration of the conductor and susceptor arrangement of FIG. 11 surrounded by thermally conductive matrix and illustrating a magnetic field encircling the susceptor wires and generating an eddy current in the susceptor wires oriented in a direction opposite the direction of the magnetic field.

Referring to FIGS. 11 and 12, shown is an embodiment of the magnetic blanket 254 having a spring susceptor 210 formed of magnetic material having a Curie temperature and provided around a conductor 220. The susceptor 210 may be formed as a solid or unitary component in a cylindrical arrangement in a spiral or spring configuration around the conductor 220 in order to enhance the flexibility of the heating blanket 254. As just one example, the susceptor 210 may comprise a first plurality of first susceptor wires having a first Curie temperature and a second plurality of second susceptor wires having a second Curie temperature, as illustrated in FIG. 6. The first Curie temperature being lower than the second Curie temperature. The plurality of first susceptor wires may be bundled or interleaved with a second plurality of second susceptor wires.

As can be seen in FIG. 12, the susceptor 210 may extend along a length of the conductor 220 within the housing 258. The application of alternating current to the conductor 220 produces an alternating magnetic field 296. The magnetic field 296 is absorbed by the magnetic material from which the susceptor 210 is formed causing the susceptor 210 to be inductively heated.

More particularly and referring to FIG. 12, the flow of alternating current through the conductor 220 results in the generation of the magnetic field 296 surrounding the susceptor 210. Eddy currents 298 generated within the susceptor 210 as a result of exposure thereof to the magnetic field 296 causes inductive heating of the susceptor 210. The housing 258 may include a thermally conductive matrix 278 material such as silicone to facilitate thermal conduction of the heat generated by the susceptor 210 to the surface of the heating blanket 254. The magnetic material from which the susceptor 210 is formed preferably has a high magnetic permeability and a Curie temperature that corresponds to the desired temperature to which a structure is to be heated by the heating blanket 254. The susceptor 210 and conductor 220 are preferably sized and configured such that at temperatures below the Curie temperature of the magnetic material, the magnetic field 296 is concentrated in the susceptor 210 due to the magnetic permeability of the material.

As a result of the close proximity of the susceptor 210 to the conductor 220, the concentration of the magnetic field 296 results in relatively large eddy currents 298 in the susceptor 210. The induced eddy currents 298 result in resistive heating of the susceptor 210. The susceptor 210 conductively heats the matrix 278 and a structure 10 (FIGS. 1-3) in thermal contact with the heating blanket 254. The heating of the first and second susceptor wires of the susceptor 210 occurs as previously described herein with reference to FIG. 6.

The magnetic materials of the first susceptor wire and the second susceptor wire may be provided in a variety of compositions including, but not limited to, a metal, an alloy, or any other suitable material having a suitable Curie temperature. For example, the first or second susceptor wire may be formed of an alloy having a composition of 32 wt. % Ni-64 wt. % Fe having a Curie temperature of approximately 390° F. The alloy may also be selected as having a composition of 34 wt. % Ni-66 wt. % Fe having a Curie temperature of approximately 450° F. However, the susceptor wires may be formed of a variety of other magnetic materials such as alloys which have Curie temperatures in the range of the particular application such as the range of the adhesive curing temperature or the curing temperature of the composite material from which the patch may be formed. Metals comprising the magnetic material may include iron, cobalt or nickel. Alloys from which the magnetic material may be formed may comprise a combination of the above-described metals including, but not limited to, iron, cobalt and nickel.

Referring to FIG. 10, the meandering conductors can be arranged in parallel and close to other segments of the conductor carrying current in the opposite direction to prevent unwanted induction in nearby metal or other conductive objects in similar manner as described in herein.

Likewise, the presently disclosed conductor (such as the conductor 80 illustrated in FIGS. 4-6 and the conductor 220 illustrated in FIGS. 8-11) may be formed of any suitable material having an electrical conductivity. Furthermore, the conductor is preferably formed of flexible material to facilitate the application of the heating blanket to curved surfaces. In this regard, the conductor may be formed of Litz wire or other similar wire configurations having a flexible nature and which are configured for carrying high frequency alternating current with minimal weight. The conductor material preferably possesses a relatively low electrical resistance in order to minimize unwanted and/or uncontrollable resistive heating of the conductor. The conductor may be provided as a single strand of wire of unitary construction or the conductor may be formed of braided material such as braided cable. In addition, the conductor may comprise a plurality of conductors which may be electrically connected in parallel in order to minimize the magnitude of the voltage otherwise required for relative long lengths of the conductor such as may be required for large heating blanket configurations.

Referring back to FIGS. 11 and 12, the heat blanket housing 258 may be formed of a flexible material to provide thermal conduction of heat generated by the susceptor sleeve to the structure to which the heating blanket is applied. In order to minimize environmental heat losses from the heating blanket 254, an insulation layer 268 may be included as illustrated in FIGS. 11 and 12. The insulation layer 268 may comprise insulation 272 formed of silicone or other suitable material to minimize heat loss by radiation to the environment. In addition, the insulation layer 268 may improve the safety and thermal efficiency of the heating blanket 254. As was indicated above, the housing 258 of the heating blanket 254 may be formed of any suitable high temperature material such as silicone or any other material having a suitable thermal conductivity and low electrical conductivity. Such material may include, but is not limited to, silicone, rubber and polyurethanes or any other thermally conductive material that is preferably flexible.

Referring back to FIGS. 5, 10 and 13, the heating blankets 54, 254, and 400 may include thermal sensors such as thermocouples or other suitable temperature sensing devices for monitoring heat at locations along the area of the heating blankets 54,254 in contact with the structure 10 (FIG. 3). Alternatively, the heating blankets 54,254 may include a voltage sensor 94,294 or other sensing devices connected to the power supply 90,290 as illustrated in FIGS. 5 and 10.

Referring still to FIGS. 5 and 10, sensors 94, 294 may be configured to indicate the voltage level provided by power supplies 90, 290, respectively. For a constant current configuration of heating blankets 54, 254, the voltage may decrease as the magnetic material approaches the Curie temperature. Power supplies 90, 290 may also be configured to facilitate adjustment of the frequency of the alternating current in order to alter the heating rate of the magnetic material. In this regard, power supplies 90, 290 may be coupled to a respective controller 92, 292 in order to facilitate adjustment of the alternating current over a predetermined range in order to facilitate the application of a heating blanket to a wide variety of structures having different heating requirements.

The presently disclosed susceptor wire array provides a number of advantages. For example, it provides for a heating blanket that provides uniform, controlled heating of large surface areas. In addition, a proper selection of the metal or alloy in the susceptor arrays' first and second susceptor wires facilitates avoiding excessive heating of the work piece irrespective of the input power. By predetermining the first and second susceptor wire metal alloys, improved control and temperature uniformity in the work piece facilitates consistent production of work pieces. The Curie temperature phenomenon of both the first and second susceptor wires (again, more than two different types of susceptor wire materials may be utilized) is used to control both the temperature ranges as well as the absolute temperature of the work piece. This Curie temperature phenomenon is also utilized to obtain substantial thermal uniformity in the work piece, by matching the Curie temperature of the susceptor to the desired temperature of the induction heating operation being performed.

The description of the different advantageous embodiments has been presented for purposes of illustration and description, and is not intended to be exhaustive or limited to the embodiments in the form disclosed. Many modifications and variations will be apparent to those of ordinary skill in the art. Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

We claim:

1. An apparatus comprising:

a plurality of wires that are electrically connected in parallel with each other, the plurality of wires comprising:

a first power lead that crosses a first edge of the apparatus and runs along the first edge of the apparatus toward a first side of the apparatus;

a first layer of wire conductors that are connected to the first power lead, wherein the first layer of wire conductors runs between the first edge of the apparatus and an opposing second edge of the apparatus, wherein the first layer of wire conductors includes one or more portions that run underneath or above the first power lead along the first edge of the apparatus;

a second layer of wire conductors, wherein the second layer of wire conductors is connected to the first layer of wire conductors and runs below the first layer of wire conductors and between the first edge of the apparatus and the opposing second edge of the apparatus; and a second power lead connected to the second layer of wire conductors, wherein the second power lead runs along the first edge of the apparatus from a second side of the apparatus that is opposite the first side toward the first side of the apparatus and crosses the first edge of the apparatus and runs below the first power lead, wherein the second layer of wire conductors forms one or more portions that run underneath or above the second power lead along the first edge of the apparatus.

2. The apparatus of claim 1 wherein the one or more portions of the first layer of wire conductors make a 180 degree turn.

3. The apparatus of claim 2 wherein the one or more portions of the first layer of wire conductors make the 180 degree turn along the first edge of the apparatus.

4. The apparatus of claim 3 wherein the one or more portions of the first layer of wire conductors make the 180 degree turn along the first edge of the apparatus by turning 90 degrees towards the second side of the apparatus.

5. The apparatus of claim 3 wherein the one or more portions of the first layer of wire conductors make the 180 degree turn along the first edge of the apparatus by turning 90 degrees towards the second side of the apparatus, and by turning 90 degrees towards the second edge of the apparatus.

6. The apparatus of claim 1, wherein the one or more portions of the second layer of wire conductors make a 180 degree turn along the first edge of the apparatus.

7. The apparatus of claim 6 wherein the one or more portions of the second layer of wire conductors make the 180 degree turn along the first edge of the apparatus by turning 90 degrees towards the second side of the apparatus.

8. The apparatus of claim 7 wherein the one or more portions of the second layer of wire conductors make the 180 degree turn along the first edge of the apparatus by turning 90 degrees towards the second side of the apparatus, and by turning 90 degrees towards the second edge of the apparatus.

9. The apparatus of claim 1, wherein the first power lead is configured to carry incoming alternating current to the apparatus.

10. The apparatus of claim 9, wherein the second power lead is configured to carry outgoing alternating current from the apparatus.

11. The apparatus of claim 1 wherein the first power lead and the second power lead are configured to carry alternating current oscillating at a frequency within a range of approximately 1,000 Hz to 400,000 Hz.

12. The apparatus of claim 1, wherein the plurality of wires comprise a Litz wire.

13. The apparatus of claim 1 further comprising:

a plurality of susceptor wires situated between the first layer of wire conductors and the second layer of wire conductors.

14. The apparatus of claim 13 wherein the plurality of susceptor wires comprise a first susceptor wire having a first Curie temperature point; and a second susceptor wire having a second Curie temperature point that is different than the first Curie temperature point of the first susceptor wire.

15. The apparatus of claim 14;

wherein the first Curie temperature point of the first susceptor wire is lower than the second Curie temperature point of the second susceptor wire.

16. The apparatus of claim 15 further comprising:

a third susceptor wire comprising a third Curie temperature point, wherein the third Curie temperature point is different from the first Curie temperature point of the first susceptor wire.

17. A heating blanket comprising:

a plurality of wires that are electrically connected in parallel with each other, the plurality of wires comprising:

a first power lead that crosses a first edge of the heating blanket and runs along the first edge of the heating blanket toward a first side of the heating blanket;

a first layer of wire conductors that are connected to the first power lead, wherein the first layer of wire conductors runs between the first edge of the heating blanket and an opposing second edge of the heating blanket, wherein the first layer of wire conductors includes one or more portions that run underneath or above the first power lead along the first edge of the heating blanket;

a second layer of wire conductors, wherein the second layer of wire conductors is connected to the first layer of wire conductors and runs below the first layer of wire conductors and between the first edge of the heating blanket and the opposing second edge of the heating blanket; and a second power lead connected to the second layer of wire conductors, wherein the second power lead runs along the first edge of the heating blanket from a second side of the heating blanket that is opposite the first side toward the first side of the heating blanket and crosses the first edge of the heating blanket and runs below the first power lead, wherein the second layer of wire conductors forms one or more portions that run underneath or above the second power lead along the first edge of the heating blanket.

18. The heating blanket of claim 17 wherein the one or more portions of the first layer of wire conductors make a 180 degree turn.

19. The heating blanket of claim 18 wherein the one or more portions of the layer of wire conductors make the 180 degree turn along the first edge of the heating blanket.

20. The heating blanket of claim 19 wherein the one or more portions of the first layer of wire conductors make the 180 degree turn along the first edge of the heating blanket by turning 90 degrees towards the second side of the heating blanket.

21. The heating blanket of claim 20 wherein the one or more portions of the first layer of wire conductors make the 180 degree turn along the first edge of the heating blanket by turning 90 degrees towards the second side of the heating blanket, and by turning 90 degrees towards the second edge of the heating blanket.

* * * * *